US011794076B2

(12) United States Patent
Garber

(10) Patent No.: US 11,794,076 B2
(45) **Date of Patent: *Oct. 24, 2023**

(54) FLOATABLE BREATHING DEVICE

(71) Applicant: J. Rodney Garber, Mount Joy, PA (US)

(72) Inventor: J. Rodney Garber, Mount Joy, PA (US)

(73) Assignee: RTB Innovations LLC, Mount Joy, PA (US)

( * ) Notice: Subject to any disclaimer, the term of this patent is extended or adjusted under 35 U.S.C. 154(b) by 198 days.

This patent is subject to a terminal disclaimer.

(21) Appl. No.: 17/115,900

(22) Filed: Dec. 9, 2020

(65) Prior Publication Data

US 2021/0086034 A1 Mar. 25, 2021

Related U.S. Application Data

(63) Continuation of application No. 16/160,251, filed on Oct. 15, 2018, now Pat. No. 10,898,761.

(51) Int. Cl.
*A63B 33/00* (2006.01)
*B63C 11/16* (2006.01)
(Continued)

(52) U.S. Cl.
CPC ..... *A63B 33/00* (2013.01); *A41D 7/00* (2013.01); *B63C 11/16* (2013.01);
(Continued)

(58) Field of Classification Search
CPC . A63B 33/00; A63B 2208/03; A63B 2244/20; A41D 7/00; A41D 7/001; B63C 11/16; B63C 2011/128; B63C 11/207
(Continued)

(56) References Cited

U.S. PATENT DOCUMENTS 5,697,362 A * 12/1997 Albrecht ..... B63C 11/205 128/201.27
D751,161 S 3/2016 Beach-Drummond
2010/0229858 A1* 9/2010 Wheelwright ..... B63C 11/205 2/426

FOREIGN PATENT DOCUMENTS

FR 573287 A * 11/1923 ..... B63C 11/207
FR 573287 6/1924

OTHER PUBLICATIONS

Translation of FR 573287, dated Jun. 20, 1924, 2 pages.

* cited by examiner

*Primary Examiner* — Elliot S Ruddie
(74) *Attorney, Agent, or Firm* — Barley Snyder

(57) ABSTRACT

The present invention relates to a floatable breathing device. The floatable breathing device provides includes a head unit, a snorkel, a plurality of receiving passageways, and an internal pathway. The head unit has buoyant properties and includes an ornamental shaped outer housing and an inner housing positioned within the outer housing, the inner housing forms a head receiving section, the head receiving section is provided between outer surfaces of the outer housing and is configured to be contoured to a human head. The snorkel connects to and extends from the head unit. The plurality of receiving passageways are disposed about the outer housing and receiving the snorkel, the snorkel extending through and exiting a portion of the head unit above a predetermined waterline extending along a periphery of a lower portion of the head unit thereof and identifies buoyancy of the head unit in water. The internal pathway positioned along a base of the outer housing and extending through a center section of the head receiving section of the head unit.

7 Claims, 11 Drawing Sheets

(51) Int. Cl.
*A41D 7/00* (2006.01)
*B63C 11/12* (2006.01)

(52) U.S. Cl.
CPC ..... *A63B 2208/03* (2013.01); *A63B 2244/20* (2013.01); *B63C 2011/128* (2013.01)

(58) Field of Classification Search
USPC ..... 128/201.11
See application file for complete search history.

FLOATABLE BREATHING DEVICE

CROSS-REFERENCE TO RELATED APPLICATIONS

This application is a continuation of U.S. patent application Ser. No. 16/160,251, filed on Oct. 15, 2018.

FIELD OF THE INVENTION

The invention is related to a floatable breathing device, and more particularly a floating breathing device having a floating ornamental head unit.

BACKGROUND

People commonly use snorkels to dive and view under water scenery. An inherent problem with the common snorkel is that for younger users they are likely to swallow water or to drop their snorkel tube below the water line thereby causing difficulty in breathing. In the current field of the invention, the user is left with the choice of only using a diving mask or goggles and surface swimming and not experiencing the under surface environment or waiting until younger divers are older more experienced and stronger swimmers who are better able to keep their tubes vertical and devoid of water. The state of the art needs a solution that permits younger divers to enjoy the benefit of being able to snorkel with their older family members without the detrimental consequences of the current state of the art. The state of the art needs a floatable breathing device.

SUMMARY

In light of the shortcoming above a floatable breathing device according to the invention is provided. The floatable breathing device provides includes a head unit, a snorkel, a plurality of receiving passageways, and an internal pathway. The head unit has buoyant properties and includes an ornamental shaped outer housing and an inner housing positioned within the outer housing, the inner housing forms a head receiving section, the head receiving section is provided between outer surfaces of the outer housing and is configured to be contoured to a human head. The snorkel connects to and extends from the head unit. The plurality of receiving passageways are disposed about the outer housing and receiving the snorkel, the snorkel extending through and exiting a portion of the head unit above a predetermined waterline extending along a periphery of a lower portion of the head unit thereof and identifies buoyancy of the head unit in water. The internal pathway positioned along a base of the outer housing and extending through a center section of the head receiving section of the head unit.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
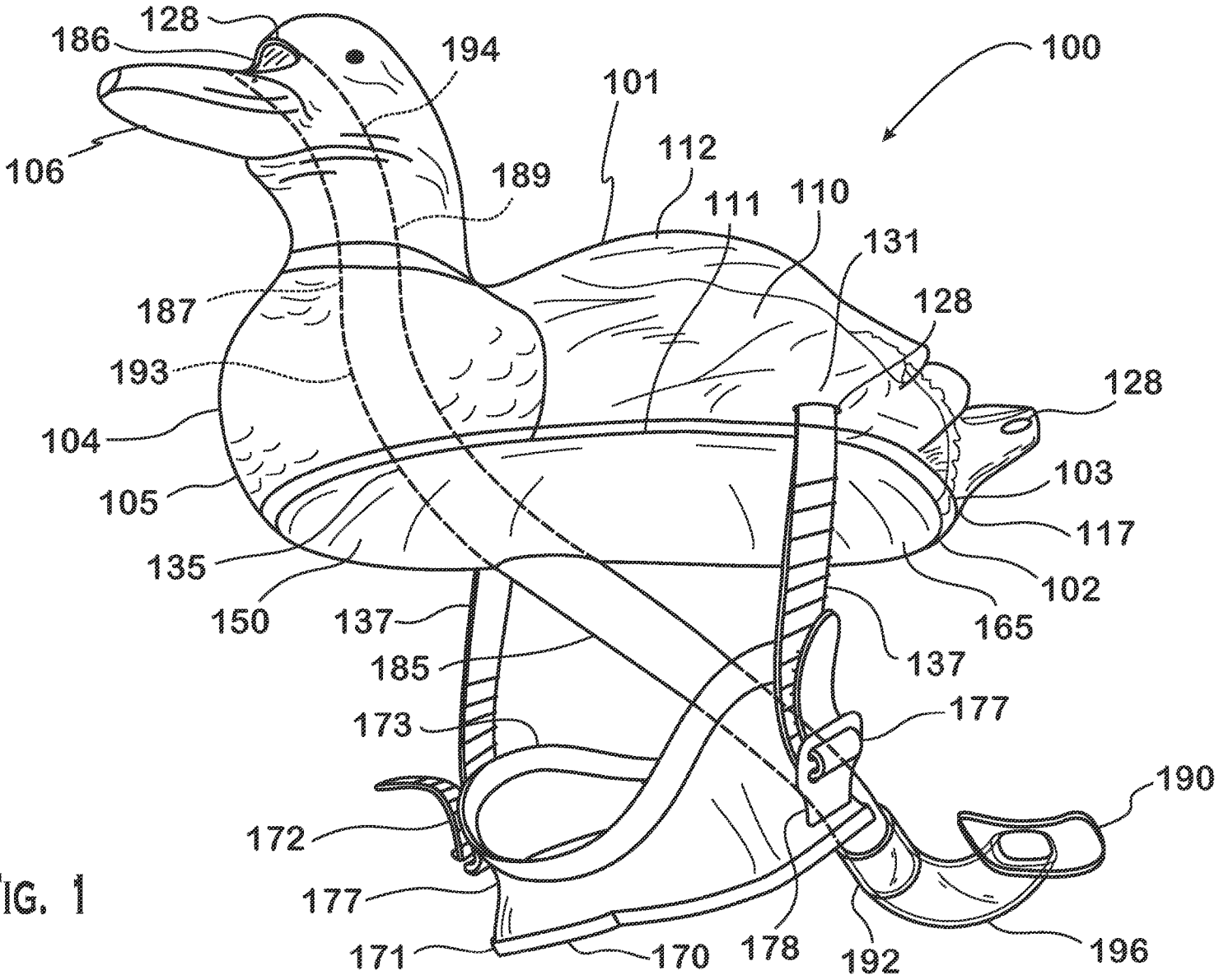
FIG. 1 is a perspective view of a floatable breathing device according to the invention.
Figure 2:
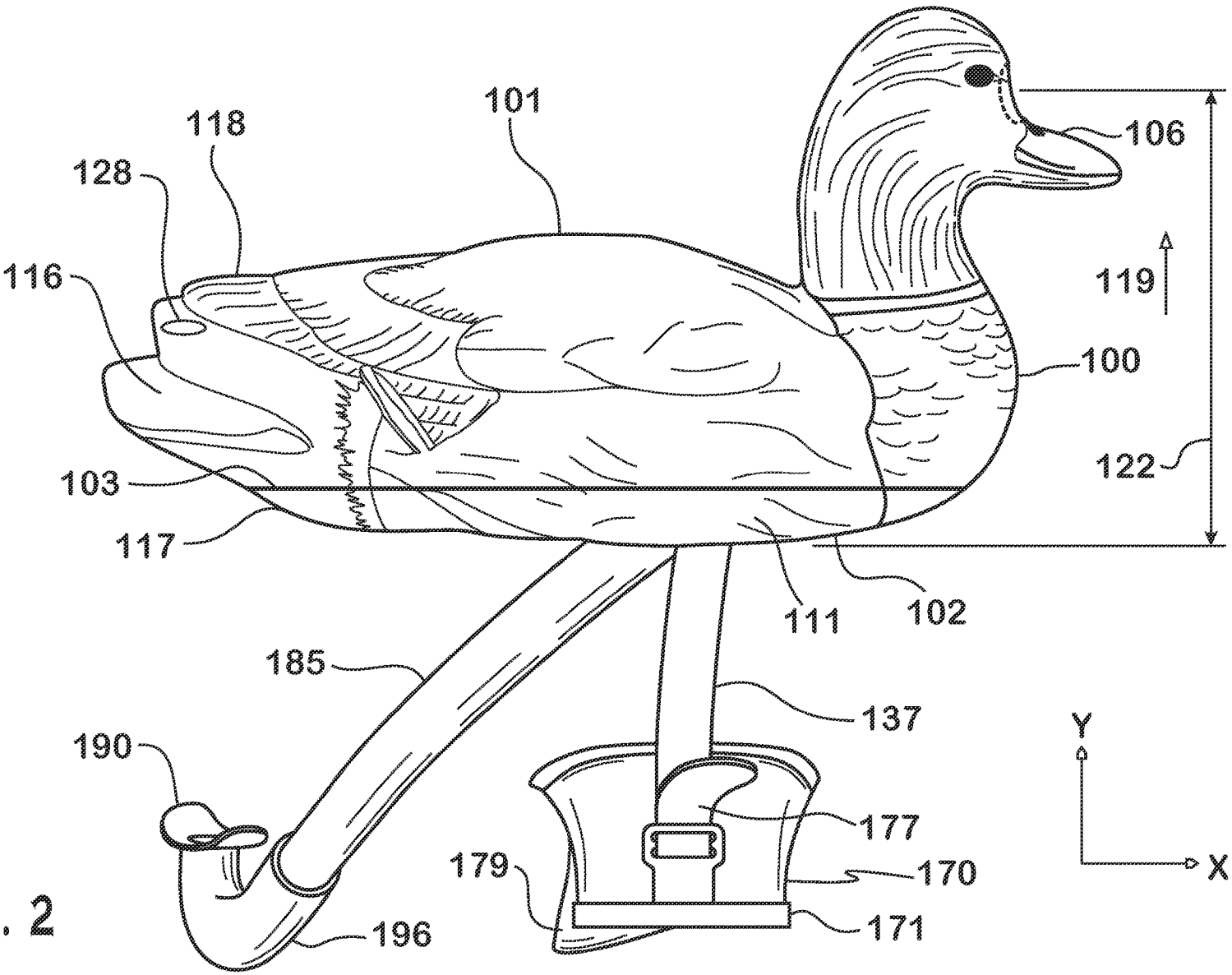
FIG. 2 is a side perspective view of a floatable breathing device of FIG. 1.

Exemplary embodiments of the present invention will be described hereinafter in detail with reference to the attached drawings, wherein like reference numerals refer to like elements.

The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Now with reference to the figures a floatable breathing device 1 according to the invention will be described. An exemplary embodiment of the invention is shown in FIG. 1, and generally includes the following major components: a head unit 100, a mask 170 and a snorkel 185.

In FIGS. 1 through 4, the head unit 100 is configured to be interchangeable and can have a variety of different ornamental shapes. The head unit 100 generally includes an outer housing 101 and a buoyant insulated housing 165.

In the shown embodiment, the outer housing 101 is a rigid exterior shell that may be formed from one or more of a materials 139, including a foam, a polymer, a composite, a water resistant fabric, or an inflatable device. The outer housing 101 may be impact resistant and may be made of buoyant material and may be monolithically formed.

The outer housing 101 is shaped to have a front portion 104, a center portion 110, and a rear portion 116. The front portion 104 has a lower front portion 105, adjacent a base 102 of the outer housing 101 and an upper front portion 106 that extends up from the lower front portion 105 of the outer housing 101. The center portion 110 has a lower center portion 111 adjacent the base 102 and an upper center portion 112 positioned up away from the base 102. A waterline 103 is also provided and extends along a periphery of the lower portions 105, 111, and 117 above the base 102. The waterline 103 is dependent on the buoyancy of the head unit 100.

Further, a plurality of receiving passageways 128 may be formed along an exterior surface 131 of the outer housing 101 to receive portions of the snorkel 185, the mask 170, or an accessory, e.g., a light, a flag, a locator beacon or any other accessory known to one of ordinary skill in the art (not shown). The receiving passageways 128 are positioned along the outer housing 101 or along an upper rear portion 118 of the outer housing 101 for the attachment of accessories e.g., a light, a flag, a locator beacon or any other accessory known to one of ordinary skill in the art. Opposite the exterior surface 131 is an interior surface 124. The interior surface 124 encompasses the inside surface of the outer housing 101.

As shown, the head unit 100 has the upper front portion 106, extending away from the base 102 in a vertical direction 119 distancing the base 102 away from the upper front portion 106 a sufficient distance 122 from the base 102 of the outer housing 101 to ensure the upper front portion 106 is relatively free of water. Further, extending along a length of the base 102 is the waterline 103 indicating the level at which water should be when the outer housing 101 is located in a body of water. A lower rear portion 117 is positioned along the base 102 and proximate to the waterline 103. Positioned on the rear portion 116 is the receiving passageway 128 adjacent to the upper rear portion 118.

In the shown embodiment, the outer housing 101 is shaped into the design of an animal, such as a bird, a fish, or a mammal. In particular, FIG. 1 illustrates the outer housing 101 formed as a duck. However, one skilled in the art should appreciate that other design are possible.

Figure 3:
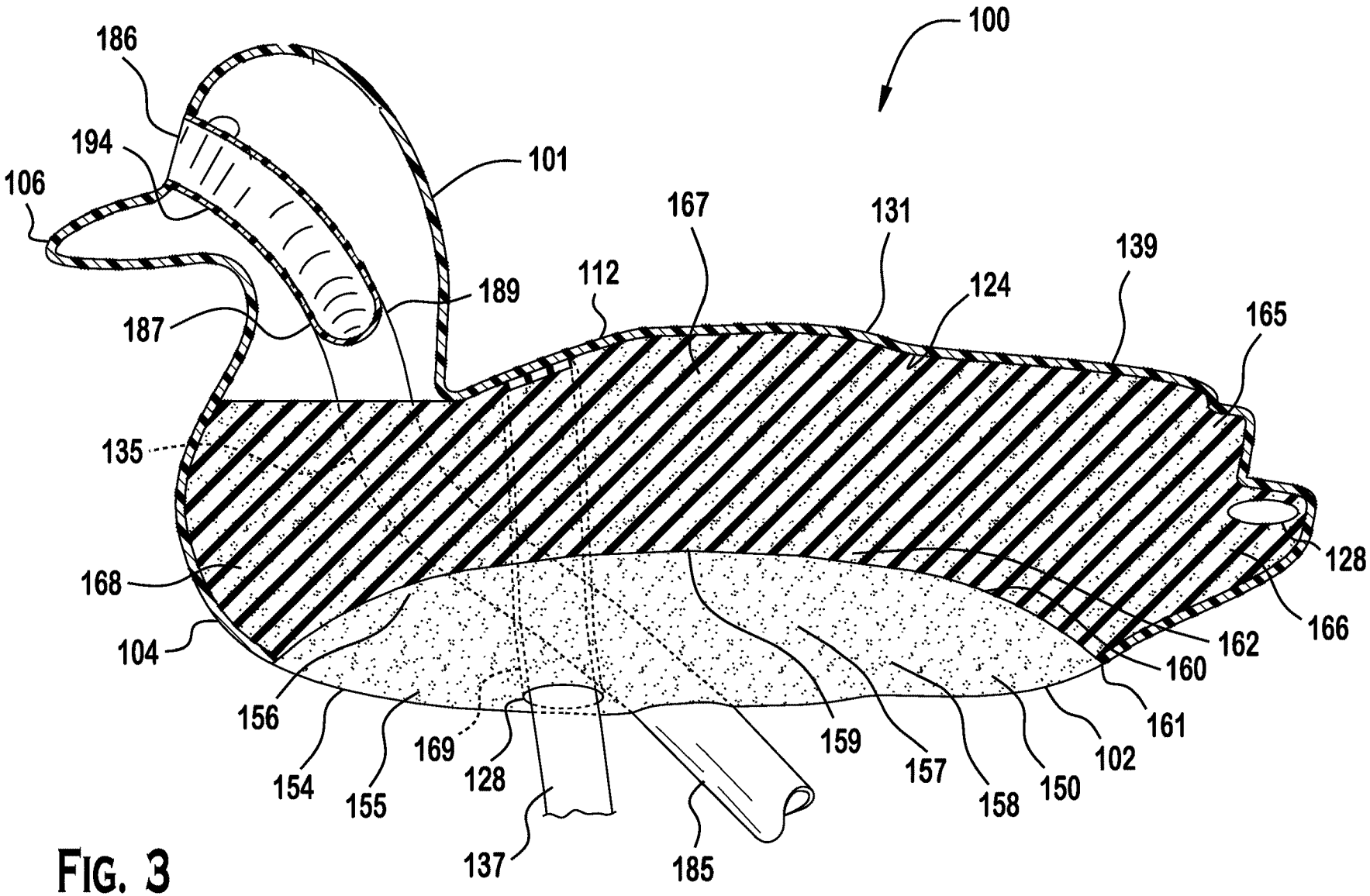
FIG. 3 is a sectional side view of the floatable breathing device of FIG. 1.

As shown in FIG. 3, the insulated housing 165 is positioned in the outer housing 101. More particularly, the insulated housing 165 is a moldable material formed in the outer housing 101 and may be a light density material such as foam or an inflatable device that includes a bladder and may be filled with a gas or be fashioned in any other way as known in the art to add buoyancy to the head unit 100. Additionally, in certain embodiments, the insulated housing 165 may be especially adapted to colder environments and have additional features to prevent heat loss by a user.

Generally, the insulated housing 165 has a rearmost insulated housing 166, a central insulated housing 167 and a front most insulated housing 168. The insulated housing 165 extends from the rearmost insulated housing 166, through the central insulated housing 167 and the front most insulated housing 168.

Formed within the insulated housing 165 is a passageway 169. The passageway 169 is formed along a portion of the central insulated housing 167 of the insulated housing 165 for receiving a strap 137. The passageway 169 extends through the side of the central insulated housing 167, up through a portion of the front most insulated housing 168 of the insulated housing 165, and a side of the center portion 110 of the outer housing 101.

A head receiving section 150 is positioned internal to the outer housing 101. More particularly, the head receiving section 150 is formed by the insulated housing 165 positioned in the outer housing 101.

As shown in FIG. 3, the head receiving section 150 has a rear section 160, a lower rear section 161, an upper rear section 162, a center section 157, a lower center section 158, an upper center section 159, a front section 154 including a lower front section 155 and an upper front section 156. The lower front section 155 of the head receiving section 150 starts along a lower edge of the front portion 104 of the outer housing 101. The head receiving section 150 is adjustable and contoured to receive a plurality of head shapes.

In the exemplary embodiment shown, the head unit 100 further includes an internal pathway 135 formed in the center section 157 of the head receiving section 150 beginning along the base 102 of the outer housing 101 continuing through the head receiving section 150 extending up from the lower center section 158 away from the base 102 through the upper center section 159 and through the upper front section 156 of the head receiving section 150 and continuing through the exterior surface 131 of the housing in the upper front portion 106.

Figure 4:
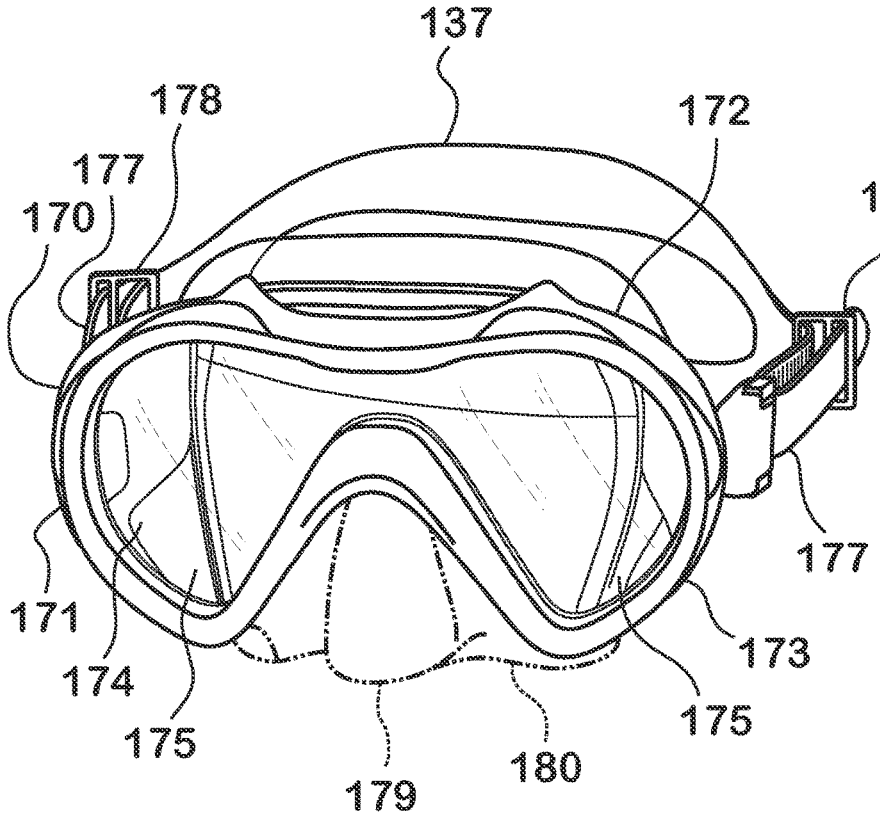
FIG. 4 is a perspective view of a mask according to the invention.

As shown in FIG. 4, the mask 170 includes a frame 171 positioned there about and a pliable skirt 172 positioned around a periphery 173 of the frame 171. A plurality of strap buckles 178 are provided and positioned along a plurality of lateral sides 177 of the mask 170.

As further shown in FIG. 4, the mask 170 has the strap 137 extending from one of the strap buckles 178 positioned on the lateral side 177 back around to another of the strap buckles 178 positioned on the lateral side 177 opposite the first. The frame 171 forms a lens socket 175 for receiving a lens 174. Along the periphery 173 of the frame 171 is the pliable skirt 172. Positioned between the lens 174 is a nose pocket 179 forming a nose seal 180 against a user. One of ordinary skill in the art would understand in some embodiments the mask 170 will have no nose pocket 179.

Figure 5:
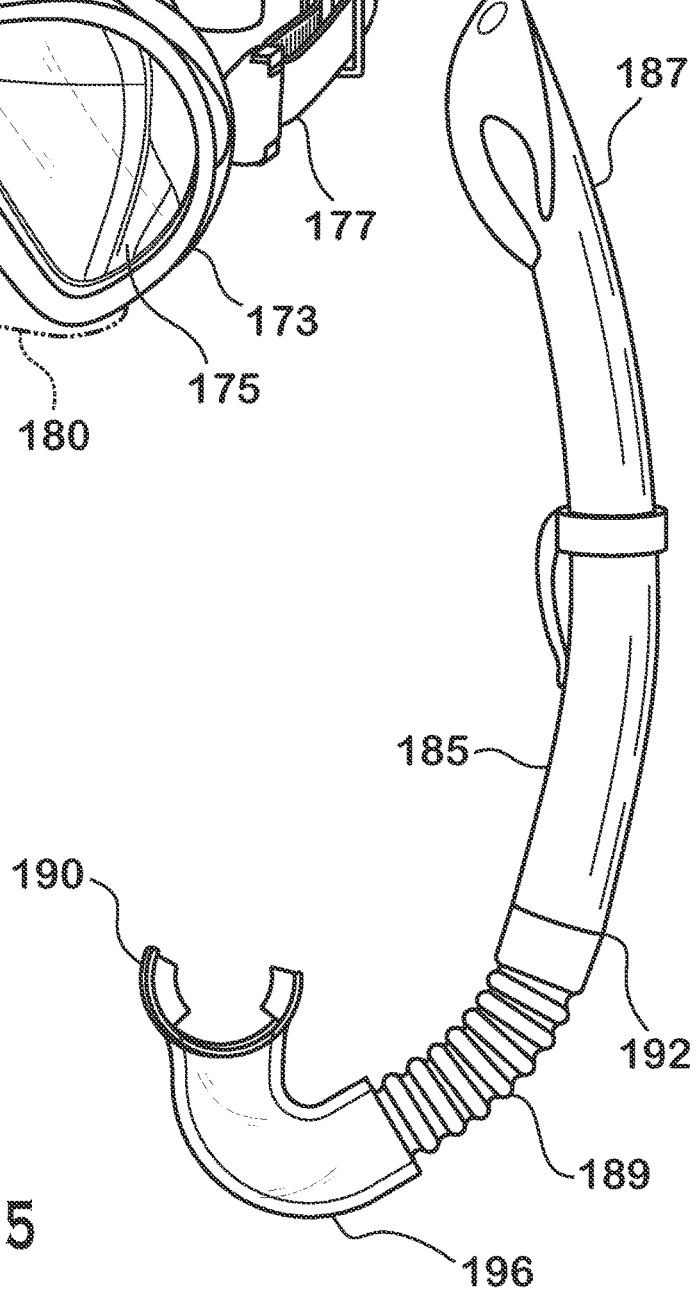
FIG. 5 is a perspective view of a snorkel according to the invention.

As shown in FIG. 5, the snorkel 185 includes an end piece 186 positioned at a proximal end thereof and a mouthpiece 190 positioned at a distal end thereof. The snorkel 185 further includes a barrel section 187 positioned below an uppermost end 194 and made of a material that includes one or more of a bendable sections 189. The snorkel 185 further includes a u-shaped section 196 positioned between the barrel section 187 and the mouthpiece 190. The snorkel 185 has a sealed section 192 along the length between the mouthpiece 190 and the end piece 186. The snorkel 185 is adaptable to different users and has a plurality of lengths 193. Further, the head units 100 may have a variety of ornamental shapes.

In the embodiment shown, the mask 170 is positioned beneath the head receiving section 150.

As shown in FIG. 5, the mouthpiece 190 is positioned at a lower portion and the u-shaped section 196 is positioned adjacent to the mouthpiece 190. The bendable section 189 can be positioned in a single position or can in some embodiments be along the length of the snorkel 185. As shown the sealed section 192 is positioned at a joint of the bendable section 189 and the barrel section 187. In other embodiments, the barrel section 187 may be entirely formed of the bendable section 189 such as when corrugated tubing or smooth flexible tubing is the barrel section 187.

Now with reference back to FIGS. 1 through 3, assembly of the head unit 100 will be described.

The outer housing 101 is positioned over the insulated housing 165 forming the head receiving section 150. Along the exterior surface 131 are the plurality of receiving passageways 128. The mask 170 with the strap 137 is secured to the mask 170 by one of the strap buckles 178 on a lateral side 177 and positioned beneath the outer housing 101. The strap 137 extends up from the mask 170 and passes through one of the receiving passageway 128 and then into the side of the central insulated housing 167, up through a portion of the front most insulated housing 168 of the insulated housing 165, and a side of the center portion 110 of the outer housing 101. The strap 137 then exists the passageway 169 through the opposing receiving passageway 128 and is connected to the mask 170 on the opposite lateral side 177 by the opposing strap buckle 178. The passageway 169 extends through the side of the central insulated housing 167, up through a portion of the front most insulated housing 168 of the insulated housing 165, and a side of the center portion 110 of the outer housing 101.

The snorkel 185 is positioned beneath the mask 170 and located within the strap 137. The mouthpiece 190 is distal the end piece 186. The barrel section 187 enters the internal pathway 135 formed in the center section 157 of the head receiving section 150 beginning along the base 102 of the outer housing 101 continuing through the head receiving section 150 extending up from the lower center section 158 away from the base 102 through the upper center section 159 and through the upper front section 156 of the head receiving section 150 and continuing through the exterior surface 131 of the outer housing 101 in the upper front portion 106. The end piece 186 exits the outer housing 101 and can be positioned in different positions at the uppermost end 194 depending upon the embodiment.

Figure 6:
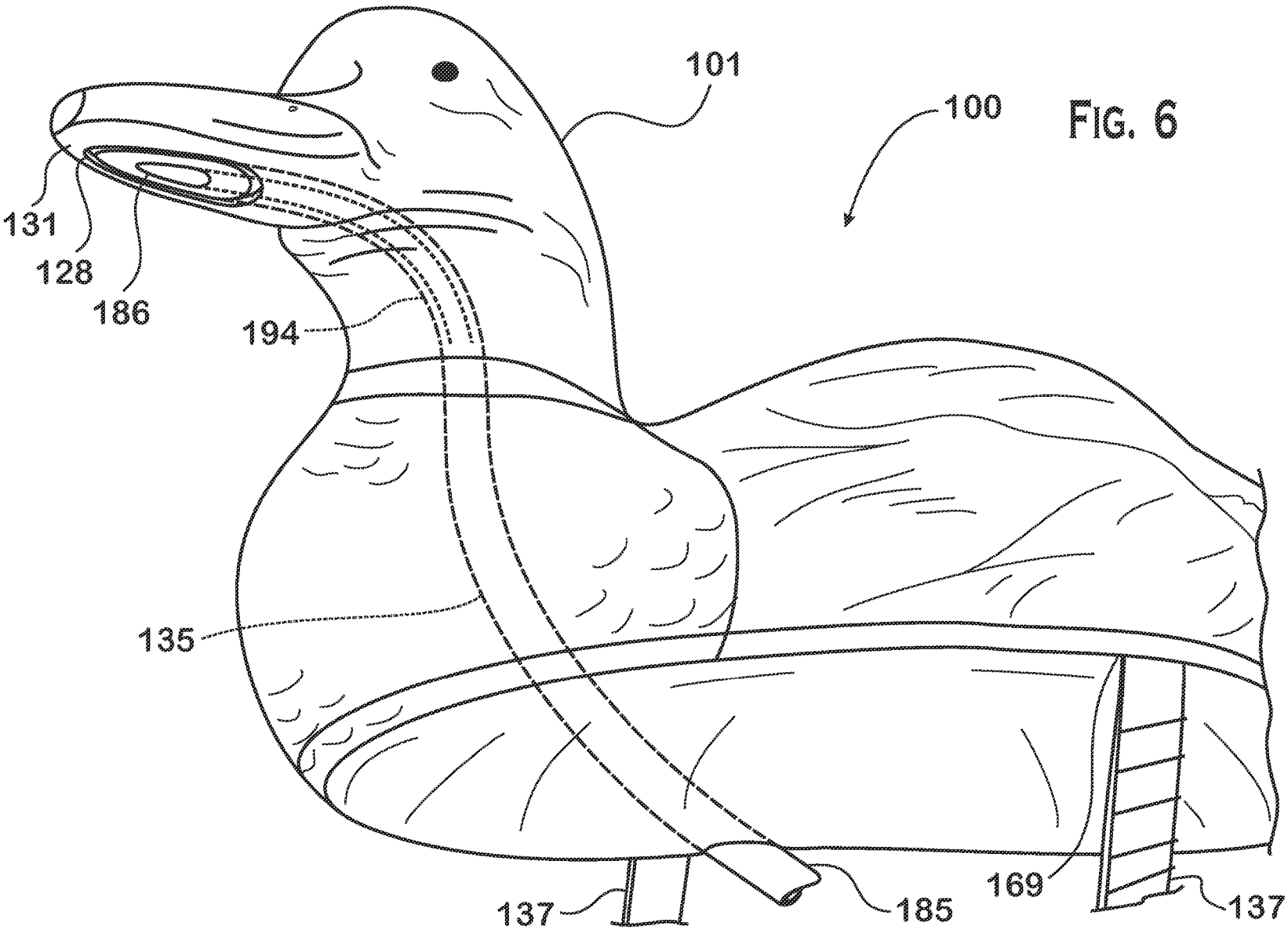
FIG. 6 is a perspective view of a head unit of another floatable breathing device according to the invention.

Now with reference to FIG. 6, an alternate embodiment of the head unit 100 will be described. For sake of brevity, only those elements that differ from the aforementioned embodiment will be described. The receiving passageway 128 is on the exterior surface 131 for the exit of the internal pathway 135. As illustrated, the snorkel 185 exits hidden under the outer housing 101 shielding the snorkel 185 from exposure to water entry.

Here the snorkel 185 passes through the internal pathway 135 and exits the outer housing 101 along the end piece 186 at the uppermost end 194. The passageway 169 for the strap 137 is hidden and passes internal to the outer housing 101 without the aid of external openings on the surface of the outer housing 101.

Figure 7:
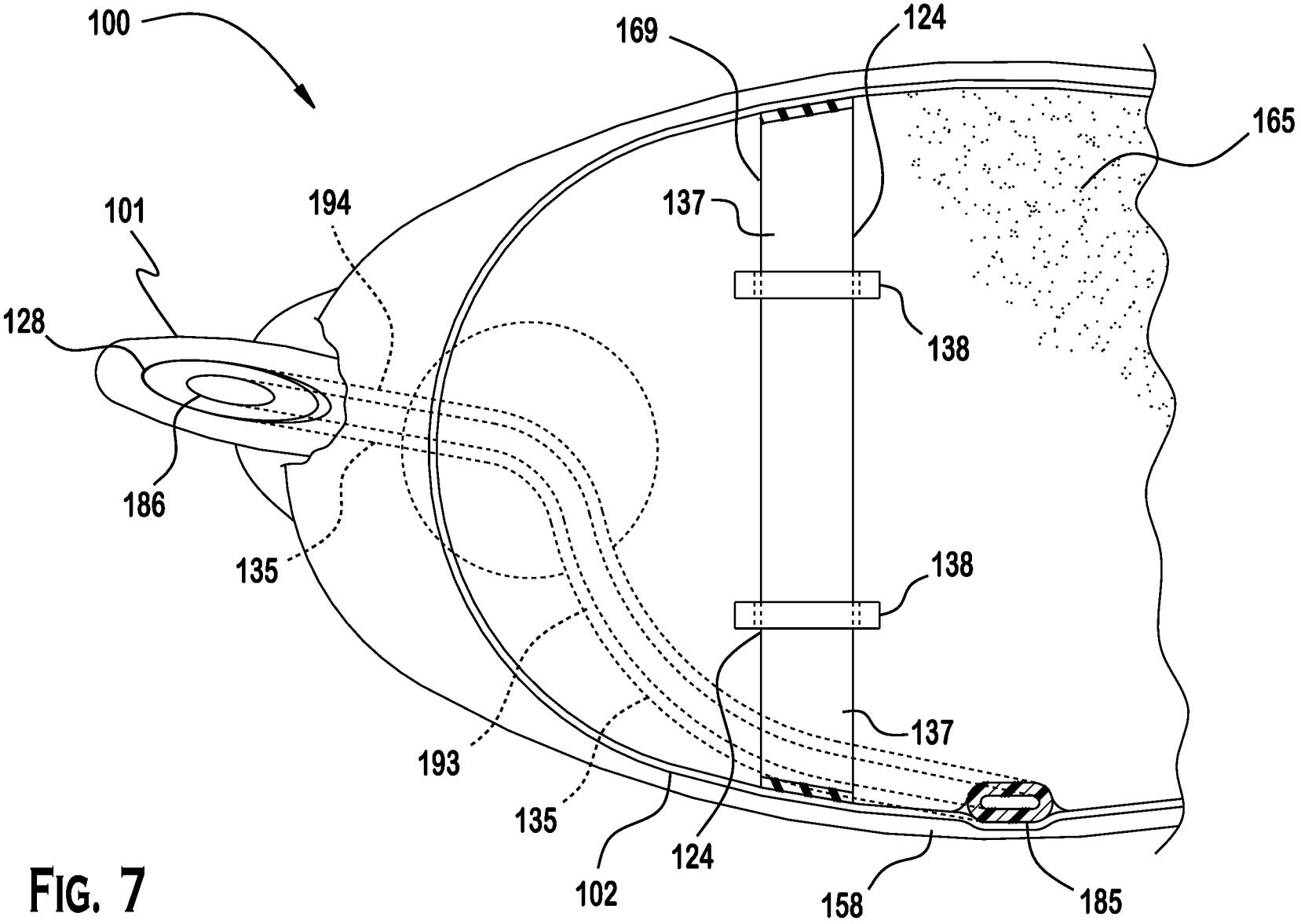
FIG. 7 is a bottom view of the head unit of FIG. 6.

As further shown FIG. 7, the snorkel 185 extends through the internal pathway 135 inside the insulated housing 165 and exits at the end piece 186 at the receiving passageway 128. It should be appreciated by one of ordinary skill in the art that the snorkel 185 may be formed of a material capable of being bent forming the bendable section 189 e.g., corrugated pipe or any other tubing having a flexible property. Likewise, the snorkel 185 is configurable to have the plurality of lengths 193. The end piece 186 is positioned at the uppermost end 194 of the snorkel 185 along the outer housing 101. The end piece 186 may in some embodiments be open in others it may contain an air valve or splash guard and in others it may also have a means of generating e.g., animal sounds or non-animal sounds during respiration of a user through the snorkel 185.

As shown in FIG. 7, the insulated housing 165, the base 102 and the snorkel 185 are viewed from below. The snorkel 185 is attached to the lower center section 158. The strap 137 is secured along the interior surface 124 of the outer housing 101 by a plurality of fasteners 138 along the center section 157 within the insulated housing 165. Additionally, the snorkel 185 passes directly through the lower front portion 105 and is secured along the interior surface 124. As shown the snorkel 185 is formed of a transparent non-corrugated material. One of ordinary skill in the art would understand that other suitable materials can be used for the snorkel 185.

Figure 10:
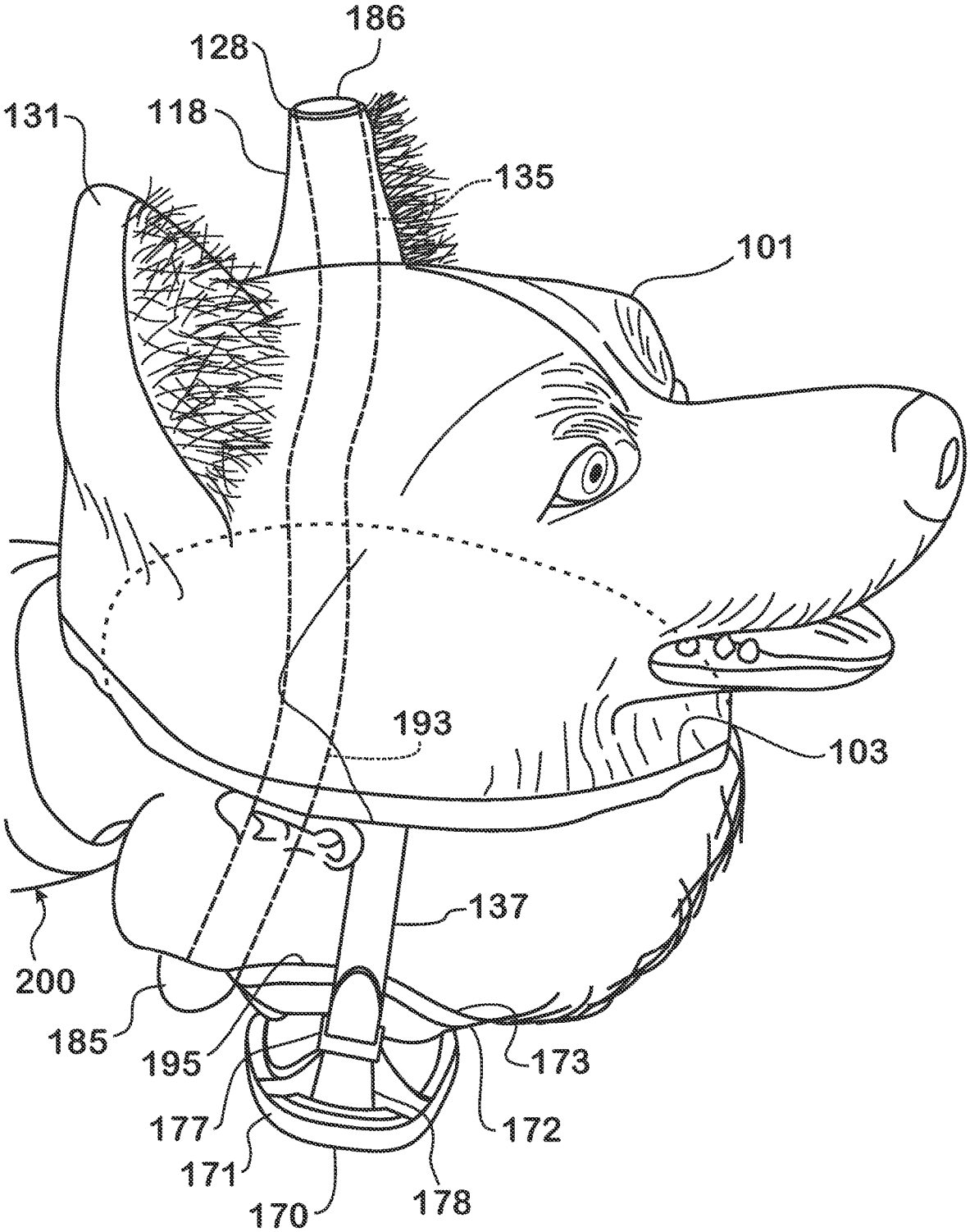
FIG. 10 is a perspective view of floatable breathing device according to the invention.

FIG. 10 shows an example alternate embodiment in a mounted state. The outer housing 101 has a different ornamental shape, namely that of a dog. The location of the receiving passageways 128 on the exterior surface 131 for the exit of the internal pathway 135 is along the upper rear portion 118 of the outer housing 101. The strap 137 is secured along the upper center portion 112 of the interior surface 124 of the outer housing 101.

Figure 8:
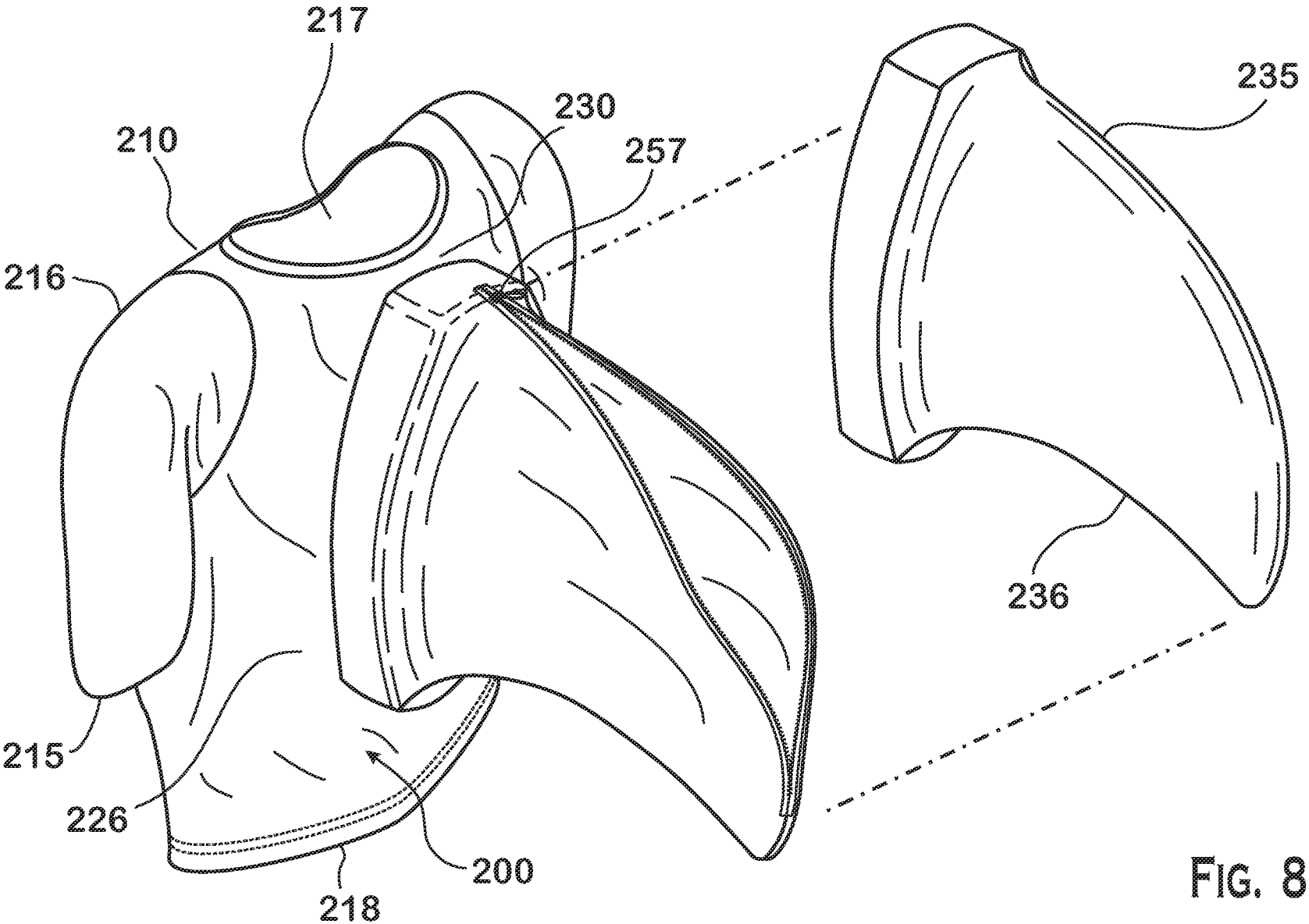
FIG. 8 is a perspective view of an integrated swim shirt assembly according to the invention.

Now with reference to FIG. 8, an integrated swim shirt assembly 200 is shown and may be used with the head unit 100 according the invention. The swim shirt assembly 200 has a swim shirt 210 and an insert receiver 230 positioned along a rear section 226 of the swim shirt 210. Around a periphery 216 of the swim shirt 210 are a plurality of arm receiving sections 215, a torso receiving section 218 and a neck receiving section 217. A changeable insert peripheral 235 can be in a variety of shapes e.g., a shark fin, a duck head, an elephant, a boat or any number of ornamental shapes and designs. The insert receiver 230 conforms to the shape of the changeable insert peripheral 235 and has an insert fastener 257 positioned along the insert receiver 230 so that the changeable insert peripheral 235 can be secured within the insert receiver 230. One of ordinary skill in the art would understand the changeable insert peripheral 235 may have a variety of ornamental shapes such as a fin 236, a shell, a plurality of alligator arms, a tail or a variety of other ornamental shapes. The changeable insert peripheral 235 may coordinate or correspond with ornamentation of the shaped head unit 100 or it may be a different ornamental shape depending upon the user's choice.

In some embodiments, the changeable insert peripheral 235 may aid in flotation by providing increased buoyancy. The integrated swim shirt assembly 200 may have properties such as UV protection and or provide a user protection from chaffing such as a rash guard. One of ordinary skill in the art would understand that the swim shirt 210 may have a variety of elements and be constructed of a plurality of materials, lengths of sleeves and sizes.

Figure 9:
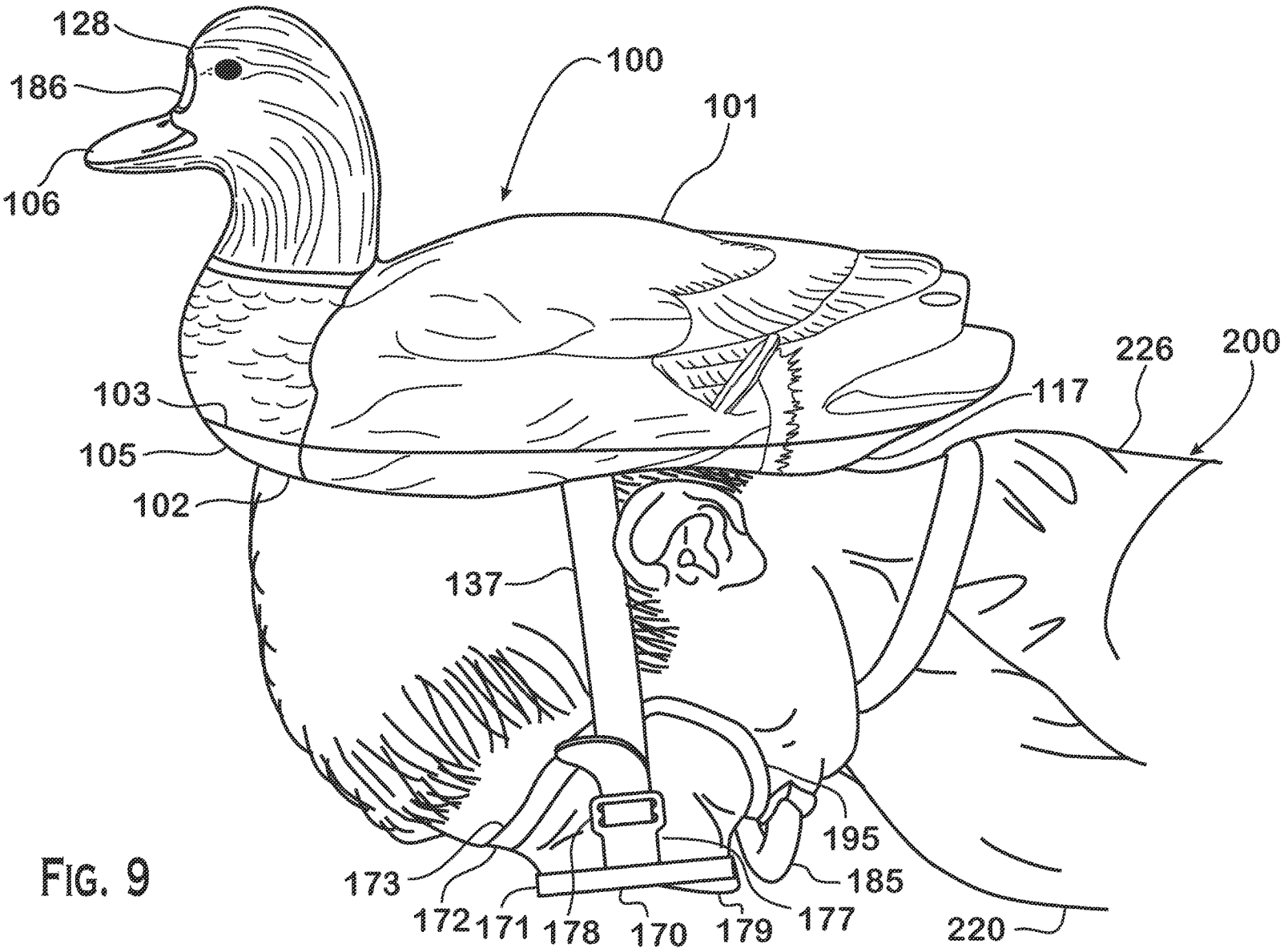
FIG. 9 is a side view of a floatable breathing device according to the invention.

Now with FIG. 9, a side view of a mounted state of the head unit 100 and the integrated swim shirt assembly 200 are shown. The base 102 of the outer housing 101 extends from the lower rear portion 117 of the user to the lower front portion 105 of the user. The integrated swim shirt assembly 200 is positioned on the user. The swim shirt 210 is coordinated in some embodiments to correspond to the outer housing 101. One of ordinary skill in the art would understand that along a front section 220 or the rear section 226 of the swim shirt 210 can be positioned flotation aids, other ornamental shapes e.g., flippers, fins, arms, legs, or any other element which may aid in swimming, flotation, or coordinating with the head unit 100 or the integrated swim shirt assembly 200.

The mask 170 is positioned along the user and the pliable skirt 172 forms a seal 195 around the periphery 173 of the mask 170. The strap 137 is connected to the strap buckles 178 located along the lateral side 177 of the frame 171 and extends around the user and through the outer housing 101. Extending along the upper front portion 106 of the outer housing 101 is the receiving passageway 128 with the end piece 186 of the snorkel 185 extending there through so that the end piece 186 is above the waterline 103.

Figure 11:
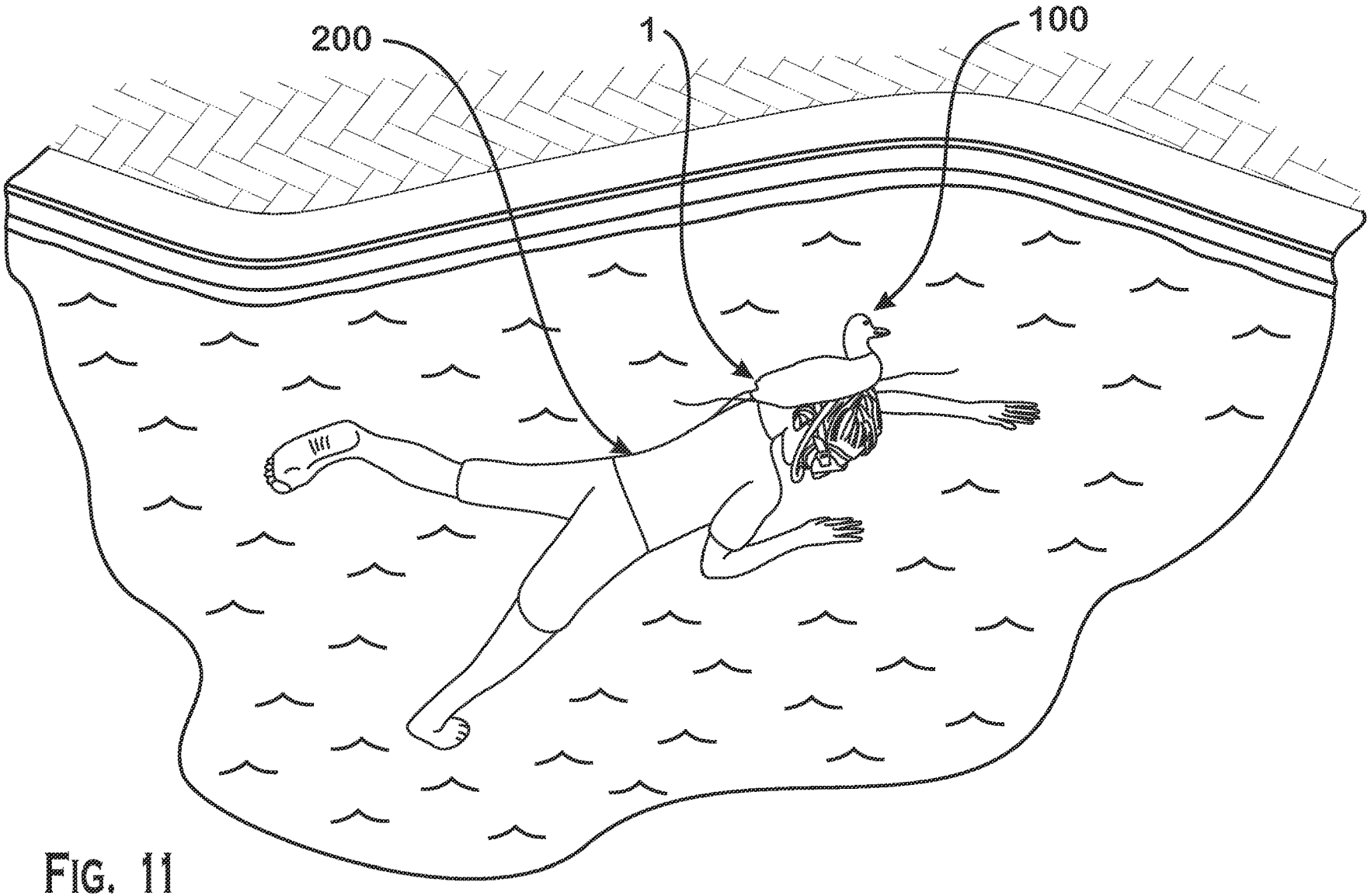
FIG. 11 is a perspective view of a floatable breathing device of the invention, shown in use.
Figure 12:
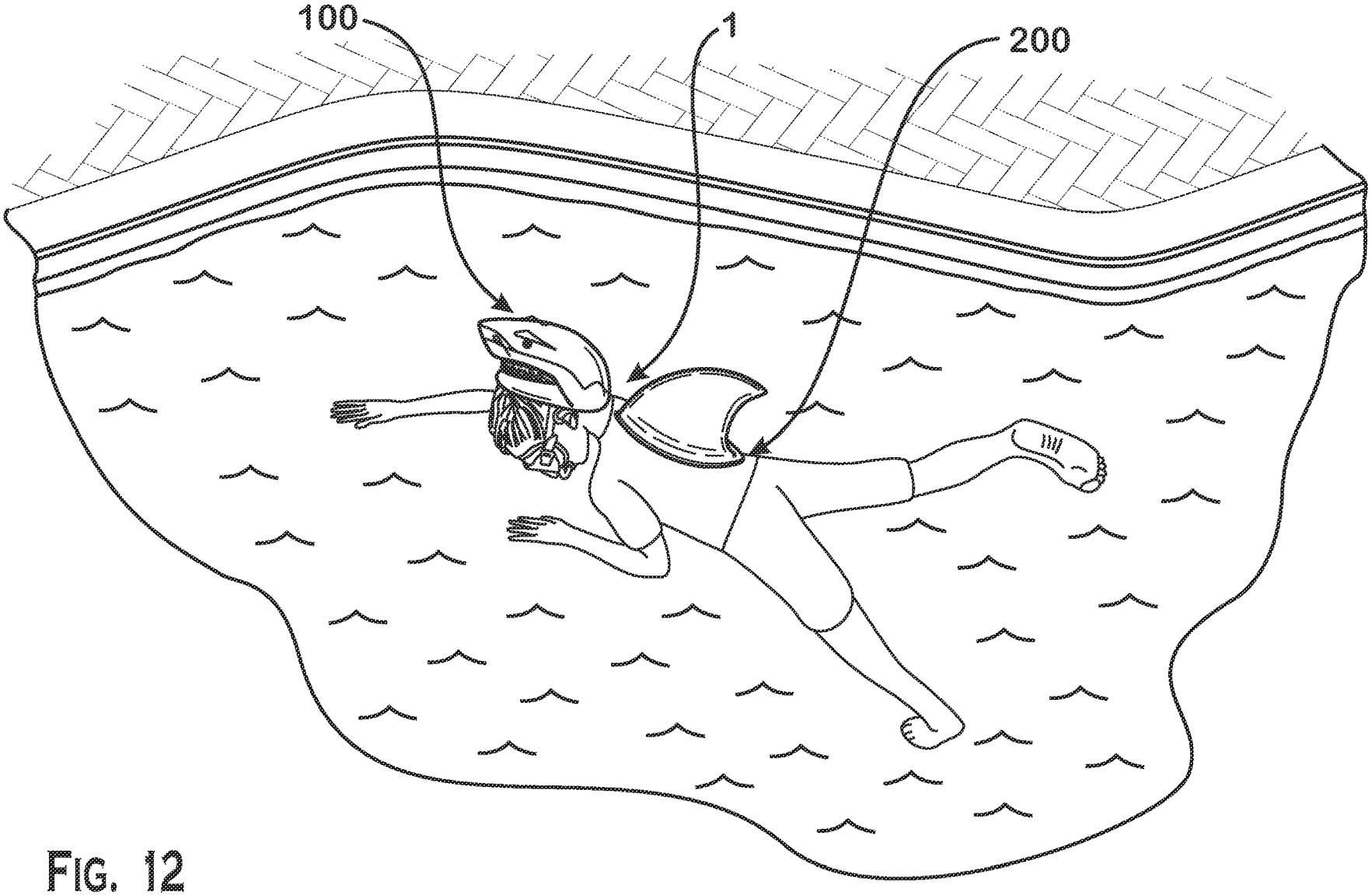
FIG. 12 is a perspective view of a floatable breathing device and an integrated swim shirt assembly according to the invention, shown in use.

As shown in FIGS. 11 and 12, the head unit 100 is positioned along the user and with the end piece 186 of the snorkel 185 positioned above the waterline 103 and hidden. The swim shirt assembly 200 is positioned over the user's torso and head so that the user's arms are extended through the arm receiving sections 215 the head through the neck receiving section 217 and the upper body through the torso receiving section 218. In other embodiments there is no changeable insert peripheral 235 in the insert receiver 230. This could be the case where the swimmer is stronger and does not need added buoyancy along their torso but still needs the aid of the head unit 100 to keep the end piece 186 above the waterline 103. In this case the swim shirt assembly 200 is worn for coordination with the head unit 100 and or for sunscreen protection or rash guard protection.

The floatable breathing device 1 adds buoyancy to the user and permits the snorkel 185 from becoming immersed below the waterline 103. Further, seen is the integrated swim shirt assembly 200 without the changeable insert peripheral 235 and alternatively with the changeable insert peripheral 235 in the shape of a shark fin. In either case, with or without the changeable insert peripheral 235, the head unit 100 keeps the end piece 186 above the waterline 103.

One of ordinary skill in the art would recognize that the ornamental shape can be a variety of configurations and designs.

The foregoing illustrates some of the possibilities for practicing the invention. Many other embodiments and fields of use for the floatable breathing device 1 are possible and within the scope and spirit of the invention. It is, therefore, intended that the foregoing description be regarded as illustrative rather than limiting.

What is claimed is:

1. A floatable breathing device, comprising a head unit with buoyant properties and having:

an ornamental shaped outer housing;

an inner housing positioned within the outer housing, the inner housing forms a head receiving section, the head receiving section is provided between outer surfaces of the outer housing and is configured to be contoured to a human head;

a snorkel connected to and extending from the head unit;

a plurality of receiving passageways disposed about the outer housing and receiving the snorkel, the snorkel extending through and exiting at a portion of the head unit above a predetermined waterline extending along a periphery of a lower portion of the head unit thereof and identifies buoyancy of the head unit in water; and an internal pathway positioned along a base of the outer housing and extending through a center section of the head receiving section of the head unit.

2. The floatable breathing device of claim 1, wherein the outer housing is an exterior shell and the inner housing is adaptable to the human head.

3. The floatable breathing device of claim 1, wherein the snorkel includes an end piece positioned at a proximal end thereof and a mouthpiece positioned at a distal end thereof.

4. The floatable breathing device of claim 3, wherein snorkel further includes a barrel section positioned below the end piece and having a bendable section.

5. The floatable breathing device of claim 4, wherein the bendable section is positioned through the internal pathway.

6. The floatable breathing device of claim 1, wherein the outer housing is shaped as an animal.

7. The floatable breathing device of claim 1, further comprising a strap receiving passageway formed along a portion of the head unit.

* * * * *